US005979600A

United States Patent [19]

Bitner

[11] Patent Number: 5,979,600

[45] Date of Patent: Nov. 9, 1999

[54] LEVELING ROOF PLATFORM SUPPORT

[76] Inventor: Shaun E. Bitner, 1915 Ridge Rd., Elizabethtown, Pa. 17022

[21] Appl. No.: 09/019,023

[22] Filed: Feb. 5, 1998

[51] Int. Cl.[6] ..... E04G 3/12

[52] U.S. Cl. ..... 182/45; 52/27; 248/237

[58] Field of Search ..... 52/27, 126.1; 248/237, 248/241, 242, 148, 371, 397, 398; 182/45

[56] References Cited

U.S. PATENT DOCUMENTS 1,599,209 9/1926 Cashman ..... 248/237
1,646,923 10/1927 Martens ..... 248/237
2,496,556 2/1950 Nelson ..... 248/237
4,450,935 5/1984 Gustavus ..... 182/45

*Primary Examiner*—Michael Safavi

[57] ABSTRACT

A leveling roof platform support having a base strip removably mounted on a roof. A support strip is hingedly connected to the upper end of the base strip. A pivot brace is attached between the base strip and the support strip. With a jack assembly, including a ball nut, rotatably coupled to the pivot brace for selectively pivoting the support strip with respect to the base strip and roof surface such that the support strip provides a horizontally oriented support surface upon a sloped roof.

9 Claims, 2 Drawing Sheets

LEVELING ROOF PLATFORM SUPPORT

BACKGROUND OF THE INVENTION

1. Field of the Invention

The present invention relates to roof platforms and more particularly pertains to a new leveling roof platform support for maintaining a roof platform horizontally oriented.

2. Description of the Prior Art

The use of roof platforms is known in the prior art. More specifically, roof platforms heretofore devised and utilized are known to consist basically of familiar, expected and obvious structural configurations, notwithstanding the myriad of designs encompassed by the crowded prior art which have been developed for the fulfillment of countless objectives and requirements.

Known prior art roof platforms include U.S. Pat. No. 5,409,266; U.S. Pat. No. 4,221,363; U.S. Pat. No. 5,113,971; U.S. Pat. No. 4,340,205; U.S. Pat. No. 5,312,088; and U.S. Pat. No. Des. 349,801.

In these respects, the leveling roof platform support according to the present invention substantially departs from the conventional concepts and designs of the prior art, and in so doing provides an apparatus primarily developed for the purpose of maintaining a roof platform horizontally oriented.

SUMMARY OF THE INVENTION

In view of the foregoing disadvantages inherent in the known types of roof platforms now present in the prior art, the present invention provides a new leveling roof platform support construction wherein the same can be utilized for maintaining a roof platform horizontally oriented.

The general purpose of the present invention, which will be described subsequently in greater detail, is to provide a new leveling roof platform support apparatus and method which has many of the advantages of the roof platforms mentioned heretofore and many novel features that result in a new leveling roof platform support which is not anticipated, rendered obvious, suggested, or even implied by any of the prior art roof platforms, either alone or in any combination thereof.

To attain this, the present invention generally comprises a base strip having a planar rectangular configuration with a top end and a bottom end. The top end has a plurality of linearly aligned circular mounting apertures formed along an axis of the base strip adjacent to a first side edge thereof, as shown in FIG. 2. Further shown in such Figure is a plurality of angled mounting slots formed between a central extent of the base strip and a second side edge thereof. The mounting slots extend outwardly and toward the bottom end with the mounting slots being in communication with the second side edge. By this structure, the base strip may be removably mounted to a roof via a plurality of nails which are in turn secured to at least one of the mounting apertures and slots. Next provided is a support strip having a width approximately equal to that of the base strip and a length half that of the base strip. The support strip has an inboard end hingably coupled to a center of the base strip. As such, the support strip pivots within a plane in which the base strip resides. As shown in FIGS. 1 & 3, an outboard end is equipped with a large inverted L-shaped member mounted thereon and extending upwardly therefrom for reasons that will become apparent hereinafter. A small upright L-shaped member is coupled to the inverted L-shaped member at its rear. With reference still to FIGS. 1 & 3, a pair of pivot braces include a first pivot brace of a first length and a bottom end hingably coupled to the base strip. Such coupling is preferably effected at a midpoint between the bottom end of the base strip and the coupling with the support strip. The pair of pivot braces further include a second pivot brace of a second length about half the first length. A top end is hingably coupled to an intermediate extent of the support strip. Further, a bottom end of the second pivot brace is hingably coupled to a top end of the first pivot brace. FIG. 3 best shows a jack assembly including a ball nut rotatably coupled to the top end of the first pivot brace and the bottom end of the second pivot brace. The jack assembly further includes a ball screw having a first end hingably coupled to a center of the base strip. Mounted on a second end of the ball screw in concentric relationship therewith is a disk-shaped handle. In operation, an intermediate threaded extent of the ball screw threadedly engages with the ball nut for raising and lowering the support strip with respect to the base strip when rotated. Finally, for indicating whether the support strip resides in a horizontal plane, a bubble level indicator is provided.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new leveling roof platform support apparatus and method which has many of the advantages of the roof platforms mentioned heretofore and many novel features that result in a new leveling roof platform support which is not anticipated, rendered obvious, suggested, or even implied by any of the prior art roof platforms, either alone or in any combination thereof.

It is another object of the present invention to provide a new leveling roof platform support which may be easily and efficiently manufactured and marketed.

It is a further object of the present invention to provide a new leveling roof platform support which is of a durable and reliable construction.

An even further object of the present invention is to provide a new leveling roof platform support which is susceptible of a low cost of manufacture with regard to both materials and labor, and which accordingly is then susceptible of low prices of sale to the consuming public, thereby making such leveling roof platform support economically available to the buying public.

Still yet another object of the present invention is to provide a new leveling roof platform support which provides in the apparatuses and methods of the prior art some of the advantages thereof, while simultaneously overcoming some of the disadvantages normally associated therewith.

Still another object of the present invention is to provide a new leveling roof platform support for maintaining a roof platform horizontally oriented.

Even still another object of the present invention is to provide a new leveling roof platform support that includes a base strip removably mounted on a roof. A support strip is hingably coupled to the base strip. Next provided is a jack assembly for selectively pivoting the support strip with respect to the base strip such that the same provides a horizontally oriented support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
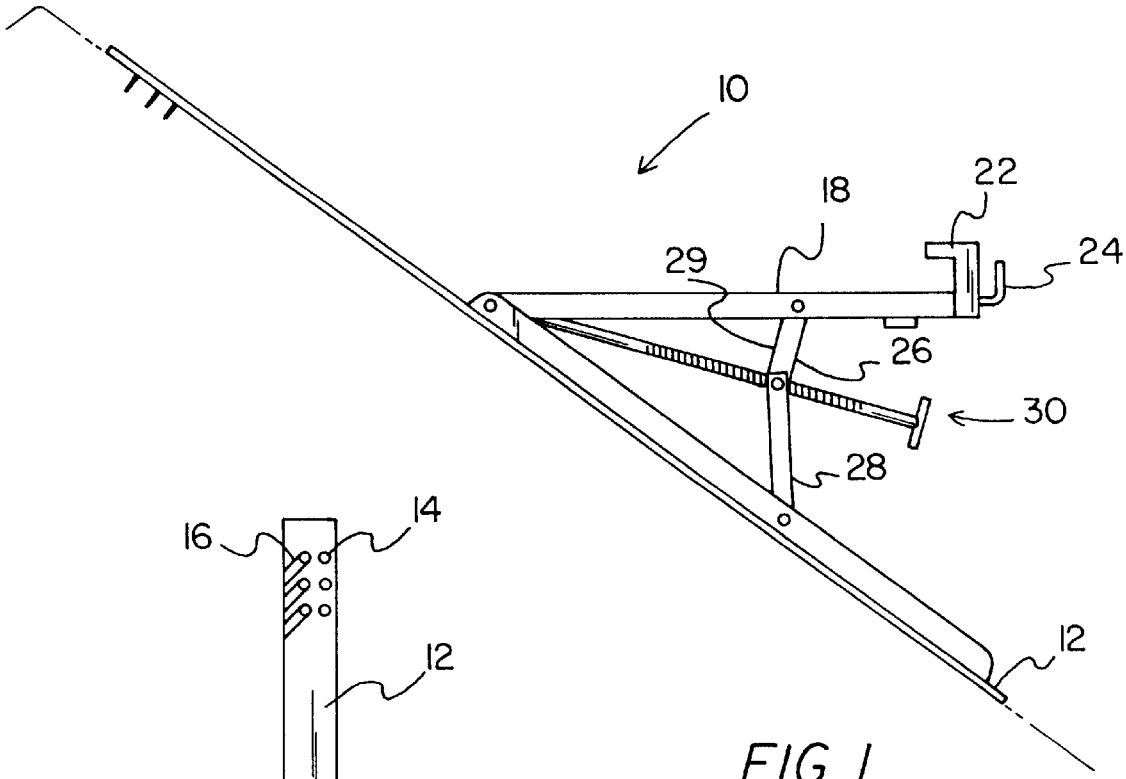
FIG. 1 is a side view of a new leveling roof platform support according to the present invention.

With reference now to the drawings, and in particular to FIGS. 1 through 4 thereof, a new leveling roof platform support embodying the principles and concepts of the present invention and generally designated by the reference numeral 10 will be described.

Figure 2:
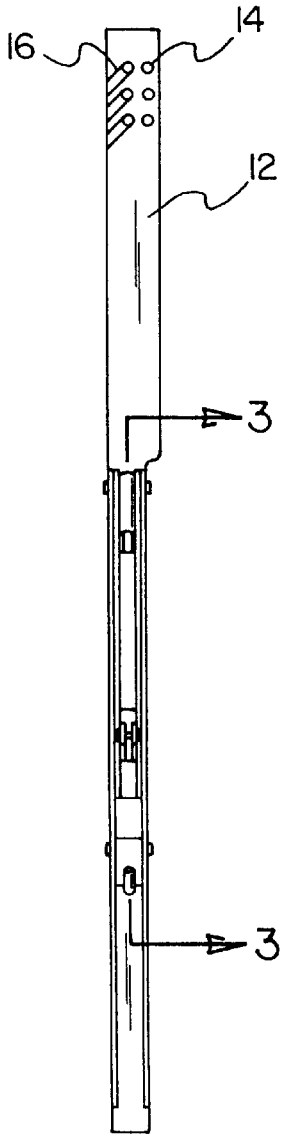
FIG. 2 is a top view of the present invention.

The present invention, designated as numeral 10, includes a base strip 12 having a planar rectangular configuration with a top end and a bottom end. The top end has a plurality of linearly aligned circular mounting apertures 14 formed along an axis of the base strip adjacent to a first side edge thereof, as shown in FIG. 2. Further shown in FIG. 2 is a plurality of angled mounting slots 16 formed between a central extent of the base strip and a second side edge thereof. The mounting slots extend outwardly and toward the bottom end with the mounting slots being in communication with the second side edge. By this structure, the base strip may be removably mounted to a roof via a plurality of nails which are in turn secured to at least one of the mounting apertures and slots.

Figure 3:
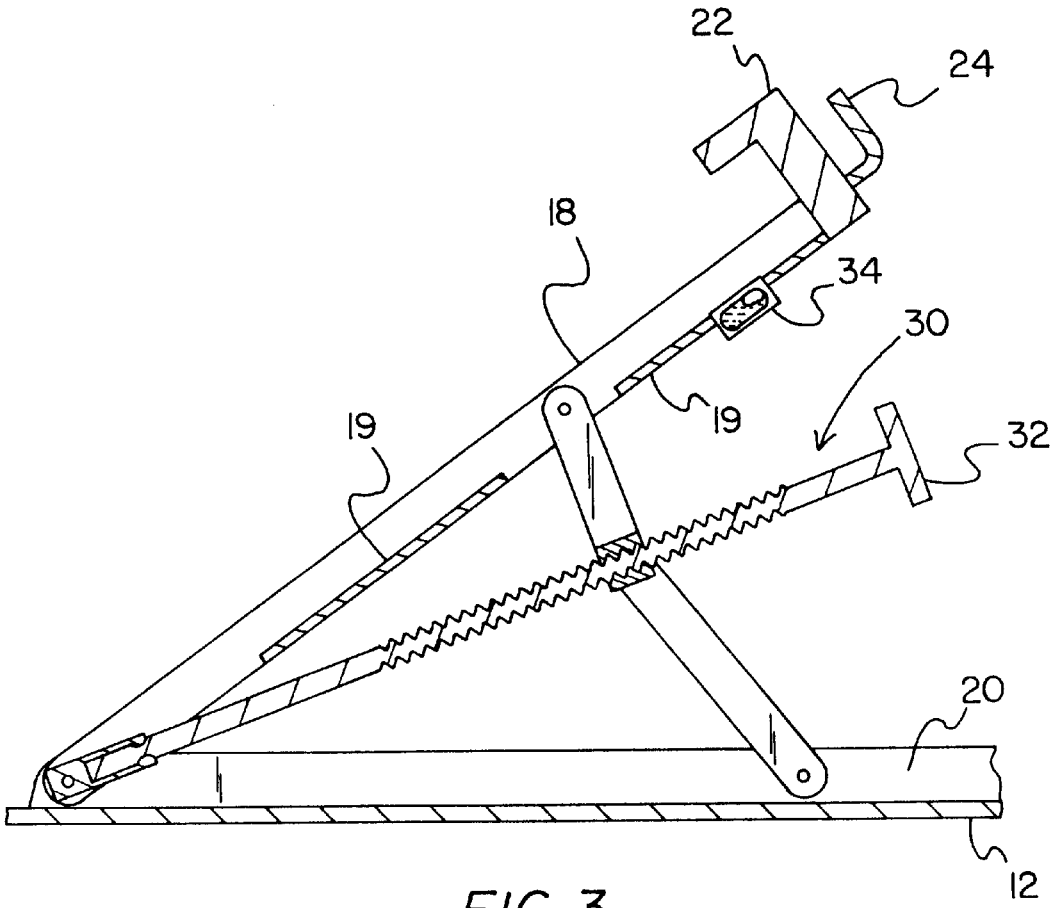
FIG. 3 is a side cross-sectional view of the present invention taken along line 3—3 shown in FIG. 2.
Figure 4:
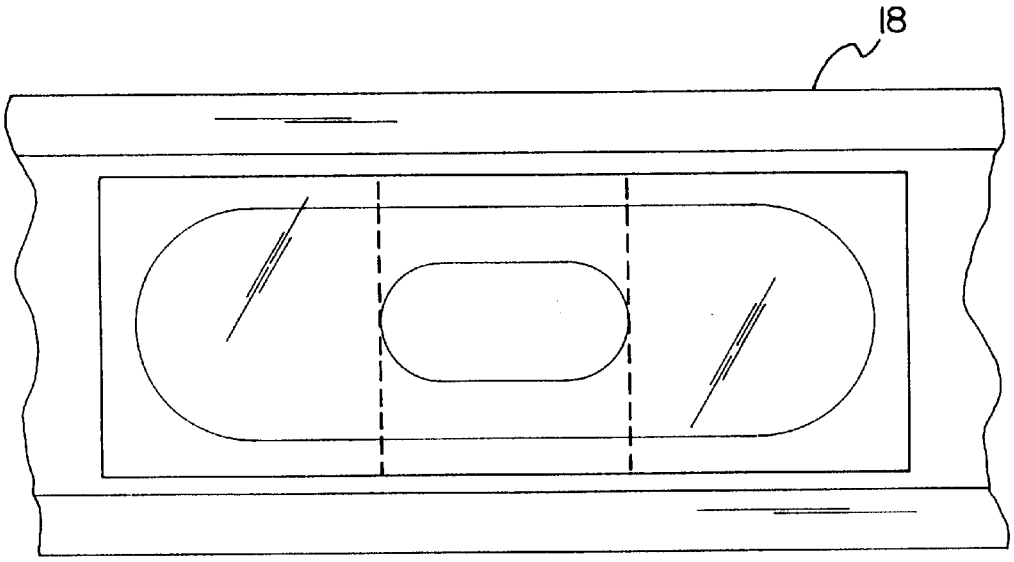
FIG. 4 is a close-up view of the bubble level indicator of the present invention.

Next provided is a support strip 18 having a width approximately equal to that of the base strip and a length half that of the base strip. As shown in FIGS. 2 & 3, the support strip comprises a pair of thin, elongated and parallel plates which are coupled together by way of a pair of interconnects 19. The support strip has an inboard end hingably coupled to a center of the base strip. To accomplish this, the base strip preferably has a pair of parallel elongated lips integrally coupled thereto and extending upwardly therefrom to define a fork 20 which extends along a bottom half of the base strip.

As such, the support strip pivots within a plane in which the base strip resides. As shown in FIGS. 1 & 3, an outboard end of the support strip is equipped with a large inverted L-shaped member 22 mounted thereon and extending upwardly therefrom for maintaining a plurality of planks on the support strip, as will become apparent hereinafter. A small upright L-shaped member 24 is coupled to the inverted L-shaped member at its rear for containing a small tool tray, spot light or hand railing.

With reference still to FIGS. 1 & 3, a pair of pivot braces 26 include a first pivot brace 28 of a first length and a bottom end hingably coupled to the base strip via the elongated fork. Such coupling is preferably effected at a midpoint between the bottom end of the base strip and the coupling with the support strip. The pair of pivot braces further include a second pivot brace 29 of a second length about half the first length. A top end of the second pivot brace is hingably coupled to an intermediate extent of the support strip between the interconnects thereof. Further, a bottom end of the second pivot brace is hingably coupled to a top end of the first pivot brace.

FIG. 3 best shows a jack assembly 30 including a ball nut rotatably coupled to the top end of the first pivot brace and the bottom end of the second pivot brace. The jack assembly further includes a ball screw having a first end hingably coupled to a center of the base strip via a sleeve which in turn is coupled to the elongated fork. The ball screw ideally has a length equal to that of the support strip. Mounted on a second end of the ball screw in concentric relationship therewith is a disk-shaped, or round handle 32. In operation, an intermediate threaded extent of the ball screw threadcdly engages with the ball nut for raising and lowering the support strip with respect to the base strip when rotated. As an option, a spring or friction may be employed prevent the ball screw from inadvertently rotating as a result of vibration.

Finally, for indicating whether the support strip resides in a horizontal plane, a bubble level indicator 34 is provided. In the preferred embodiment, the bubble level is positioned adjacent the outboard end of the support strip.

In use, a plurality of the foregoing platform supports may be utilized to maintain at least one plank horizontally oriented on a house. As such, work may be safely performed on the roof. To allow convenient storage and transporting, each component of the platform support preferably resides in a common plane during use and may be collapsed along a single axis after use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leveling roof platform support comprising, in combination:

a base strip having a planar rectangular configuration with a top end and a bottom end, the top end having a plurality of linearly aligned circular mounting apertures formed along an axis of the base strip adjacent to a first side edge thereof and a plurality of angled mounting slots formed between a central extent of the base strip and a second side edges of the base strip with the mounting slots extending outwardly and toward the bottom end with the mounting slots being in communication with the second side edge, the base strip being mounted to a roof via a plurality of nails which are in turn secured to at least one of the mounting apertures and slots;

a support strip having a width approximately equal to that of the base strip and a length half that of the base strip, the support strip having an inboard end hingably coupled to a center of the base strip thereby allowing the support strip to pivot within a plane in which the base strip resides and an outboard end with a large inverted L-shaped member mounted thereon and extending upwardly therefrom and a small upright L-shaped member coupled to the inverted L-shaped member at a rear thereof;

a pair of pivot braces including a first pivot brace having a bottom end hingably coupled to the base strip at a midpoint between the bottom end of the base strip and the hingable coupling between the base strip and the support strip, the pair of pivot braces further including a second pivot brace of a second length about half the first length, a top end hingably coupled to an intermediate extent of the support strip and a bottom end hingably coupled to a top end of the first pivot brace;

a jack assembly including a ball nut rotatably coupled to the top end of the first pivot brace and the bottom end of the second pivot brace, the jack assembly further including a ball screw having a first end hingably coupled to a center of the base strip, a second end with a disk-shaped handle mounted thereon in concentric relationship therewith, and an intermediate threaded extent threadedly engaged with the ball nut for raising and lowering the support strip with respect to the base strip upon the rotation thereof; and a bubble level indicator positioned adjacent the outboard end of the support strip for indicating whether the support strip resides in a horizontal plane.

2. A leveling roof platform support comprising:

a base strip removably mounted on a roof;

a support strip pivotally coupled to the base strip;

a pair of pivot braces including a first pivot brace having a bottom end pivotally coupled to the base strip at a midpoint between a bottom end of the base strip and the pivotable coupling of support strip to the base strip;

the pair of pivot braces further including a second pivot brace having a top end pivotally coupled to the support strip and a bottom end pivotably coupled to a top end of the first pivot brace;

a jack assembly including a ball nut rotatably coupled to the top end of the first pivot brace and the bottom end of the second pivot brace;

the jack assembly further including a ball screw having a first end pivotally coupled to the base strip adjacent the pivot coupling of support strip to the base strip; and the ball screw having a second end with a disk-shaped handle mounted thereon in concentric relationship therewith, and an intermediate threaded extent threadedly engaged with the ball nut for raising and lowering the support strip with respect to the base strip upon the rotation thereof.

3. A leveling roof platform support as set forth in claim 2 wherein a level indicator is provided for indicating whether the support strip is horizontally oriented.

4. A leveling roof platform support as set forth in claim 2 wherein the means includes a jack assembly.

5. A leveling roof platform support as set forth in claim 2 wherein the support strip has a width approximately equal to that of the base strip.

6. A leveling roof platform support as set forth in claim 2 wherein the support strip has a member extending upwardly from an outboard end thereof.

7. A leveling roof platform support as set forth in claim 2 wherein the base strip has a plurality of linearly aligned circular mounting apertures formed therein.

8. A leveling roof platform support as set forth in claim 2 wherein the base strip has a plurality of angled mounting slots formed therein with the mounting slots being in communication with a side edge of the base strip.

9. A leveling roof platform support comprising, in combination:

a base strip having a planar rectangular configuration with a top end and a bottom end, the top end having a plurality of linearly aligned circular mounting apertures formed along an axis of the base strip adjacent to a first side edge thereof and a plurality of angled mounting slots formed between a central extent of the base strip and a second side edges of the base strip with the mounting slots extending outwardly and toward the bottom end with the mounting slots being in communication with the second side edge, the base strip being mounted to a roof via a plurality of nails which are in turn secured to at least one of the mounting apertures and slots;

the base strip having a pair of parallel elongate lips integrally coupled thereto and extending upwardly therefrom to defined a fork extending along a bottom half of the base strip;

a support strip having a width approximately equal to that of the base strip and a length half that of the base strip, the support strip comprising a pair of elongated and parallel plates being coupled together by a pair of interconnects extending between the plates of the support strip, the support strip having an inboard end pivotably coupled to the fork between the lips of the base strip at a center of the base strip thereby allowing the support strip to pivot within a plane in which the base strip resides and an outboard end with a large inverted L-shaped member mounted thereon and extending upwardly therefrom and a small upright L-shaped member coupled to the inverted L-shaped member at a rear thereof;

a pair of pivot braces including a first pivot brace having a bottom end pivotably coupled to the base strip at a midpoint between the bottom end of the base strip and the pivotable coupling between the base strip and the support strip, the pair of pivot braces further including a second pivot brace having a top end pivotably coupled to an intermediate extent of the support strip and a bottom end pivotably coupled to a top end of the first pivot brace;

a jack assembly including a ball nut rotatably coupled to the top end of the first pivot brace and the bottom end of the second pivot brace, the jack assembly further including a ball screw having a first end pivotably coupled to a center of the base strip via a sleeve coupled to the fork of the base strip, a second end with a disk-shaped handle mounted thereon in concentric relationship therewith, and an intermediate threaded extent threadedly engaged with the ball nut for raising and lowering the support strip with respect to the base strip upon the rotation thereof; and a bubble level indicator positioned adjacent the outboard end of the support strip for indicating whether the support strip resides in a horizontal plane.

* * * * *